US005996568A

United States Patent [19]

Ryan

[11] Patent Number: 5,996,568

[45] Date of Patent: Dec. 7, 1999

[54] PROCESS FOR PROPELLING FOODSTUFFS OR THE LIKE INTO A CROWD

[75] Inventor: Thomas Gerard Ryan, Souderton, Pa.

[73] Assignee: Hatfield, Inc., Hatfield, Pa.

[21] Appl. No.: 08/831,483

[22] Filed: Mar. 31, 1997

[51] Int. Cl.[6] ..... F41B 11/00

[52] U.S. Cl. ..... 124/56

[58] Field of Search ..... 124/56, 70, 73, 124/83

[56] References Cited

U.S. PATENT DOCUMENTS

| | | |
|---|---|---|
| 279,965 | 6/1883 | Mefford . |
| 884,024 | 4/1908 | Lake . |
| 2,526,018 | 10/1950 | Foster et al. . |
| 2,703,944 | 3/1955 | Molyneux . |
| 5,553,599 | 9/1996 | Benavides . |
| 5,660,160 | 8/1997 | Prescott . |

*Primary Examiner*—John A. Ricci
*Attorney, Agent, or Firm*—Knoble & Yoshida LLC

[57] ABSTRACT

A method of promoting a product or product brand at a public event that is safe, fun, and very entertaining includes steps of wrapping a product in a wrapper that is designed not to come apart when flying through the air, that is relatively soft and without any hard or sharp edges, and that is flexible, compressible and relatively airtight, placing the product and its wrapper within a tube in a manner such that the compressible, relatively airtight package forms a seal with an inner wall of the tube, and ejecting the product and its wrapper out of the tube and toward an audience by applying a pressurized gas within the tube, whereby the flexible, compressible and relatively airtight wrapper both helps seal the wrapper to the tube in order to make the ejection process efficient, and acts to keep the package together as it travels toward the audience.

5 Claims, 2 Drawing Sheets

PROCESS FOR PROPELLING FOODSTUFFS OR THE LIKE INTO A CROWD

BACKGROUND OF THE INVENTION

1. Field of the Invention

This invention relates in general to the field of marketing and promoting foodstuffs, such as hot dogs, at public events such as baseball and football games. More specifically, this invention relates to a method of launching foodstuffs into a crowd for promotional and entertainment purposes in a way that is safe, sanitary, simple and amusing to observe.

2. Description of the Prior Art

Consumer marketing of all sorts of products, running the gamut from food and beverages to office supplies, is omnipresent at public events such as athletic contests, concerts and other exhibitions. Nearly all professional athletic teams have corporate sponsors whose products are advertised prominently within the team's stadium or arena, and who participate in promotional events with the teams throughout the season. Stadium advertising can provide a sponsor with widespread exposure, particularly if the team's contests are televised to a wide audience. A prominent banner in center field, for example, can make its way onto television several times in a single contest.

Television coverage, when not focused on the game, also typically takes "look-around" shots about the stadium, for example zooming in on persons in the stands, or showing viewers at home the antics of the team's mascot. Of course, the more amusing the mascot or other entertainment is, the more likely it will be to get television exposure, as well as the attention of the audience in attendance. If the mascot or entertainment is working with a sponsor to promote a product or a product brand during the game, it is particularly important to get the attention of as many people as possible. It is within this context that the invention has particular importance.

SUMMARY OF THE INVENTION

It is an object of the invention to provide a system and method of promoting a product or product brand at a public event that is safe, fun, and very entertaining, so as to guarantee a high level of audience attention.

In order to achieve the above and other objects of the invention a method of promoting a product or product brand at a public event that is safe, fun, and very entertaining includes, according to first aspect of the invention steps of (a) wrapping a product-in a wrapper that is designed not to come apart when flying through the air, that is relatively soft and without any hard or sharp edges, and that is flexible, compressible and relatively airtight; (b) placing the product and its wrapper within a tube in a manner such that the compressible, relatively airtight package forms a seal with an inner wall of the tube; and (c) ejecting the product and its wrapper out of the tube and toward an audience by applying a pressurized gas within the tube, whereby the flexible, compressible and relatively airtight wrapper both helps seal the wrapper to the tube in order to make the ejection process efficient, and acts to keep the package together as it travels toward the audience.

According to a second aspect of the invention, a method of promoting a food product or product brand at a public event that is safe, fun, and very entertaining includes steps of: (a) wrapping a food product in a wrapper that is designed not to come apart when flying through the air, that is relatively soft and without any hard or sharp edges; (b) placing the product and its wrapper within a gun-like mechanism; and (c) ejecting the product and its wrapper out of the gun-like mechanism into an audience in order to both give away a promotional sample of the foodstuff and to gain the attention of the audience to the food product These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
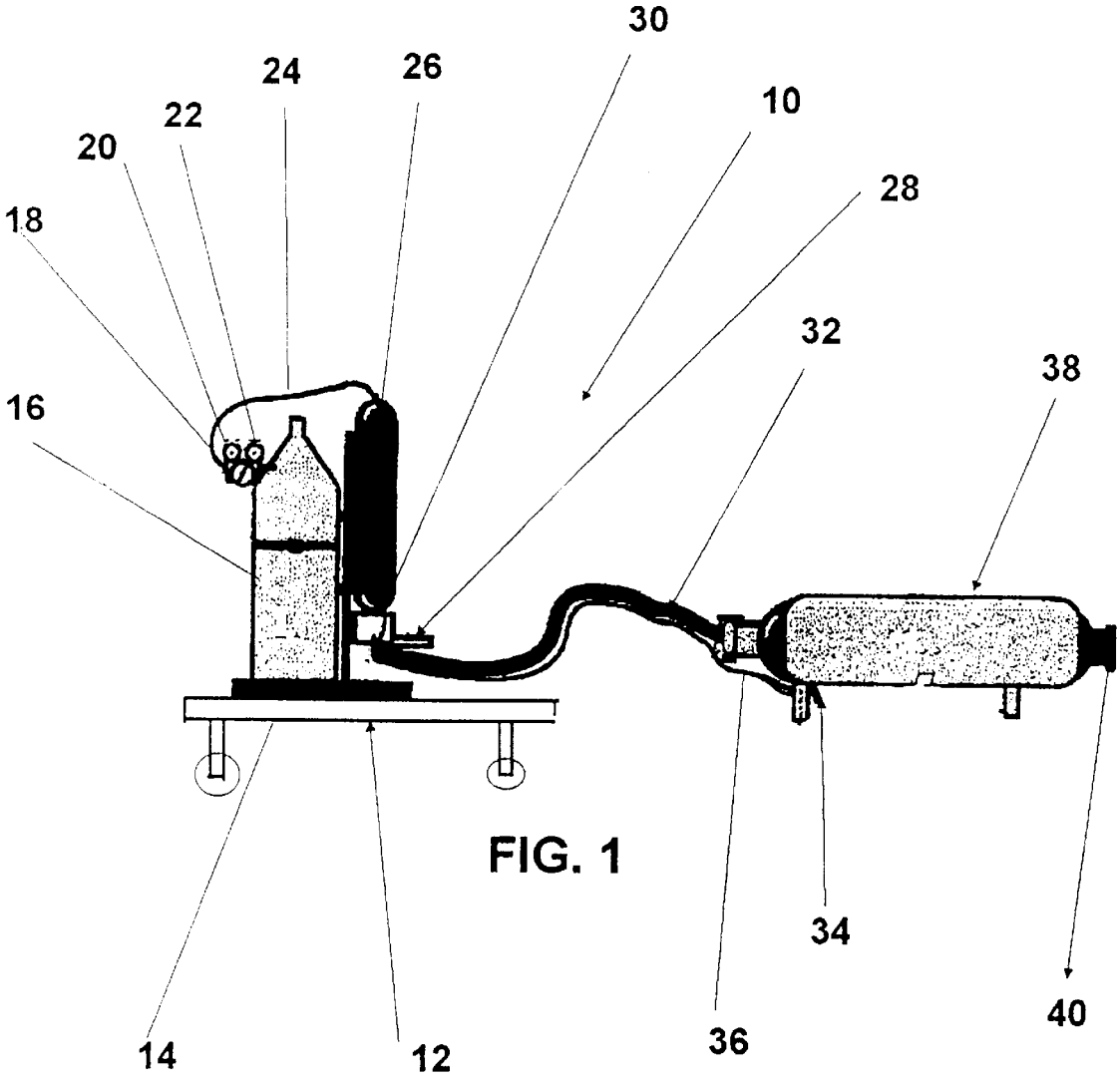
FIG. 1 is a diagrammatical drawing depicting an apparatus for ejecting foodstuffs or the like into a crowd that is constructed according to a preferred embodiment of the invention.

Referring now to the drawings, wherein like reference numerals designate corresponding structure throughout the views, and referring in particular to FIG. 1, a system 10 for launching a product through the air into an audience includes a support assembly 12 that, in the preferred embodiment, includes a wheeled vehicle 14 that permits the system 10 to be pulled or driven about a stadium or other public place, such as by a mascot who is in charge of shooting the product into the crowd. System 10 further includes a container 16 or other source of pressurized gas, which in the preferred embodiment is a container of pressurized carbon dioxide. Container 16 is connected to a regulator 18, which includes a first pressure gauge 20 for measuring the pressure in an accumulator tank 26, and a second pressure gauge 22 for measuring the pressure in the container 16. A first pressure line 24 connects regulator 18 with accumulator tank 26. A second pressure line 32 connects the accumulator tank 26 with a connection 50 on a stylized gun-like mechanism 38, which will be discussed in greater detail below. A ball valve 28 is interposed between the accumulator tank 26 and pressure line 32. Also interposed between those elements is a remote-controlled valve 30, which is normally closed, but is openable upon actuation of a trigger 34 on the stylized gun-like mechanism 38. A signal line 36 is used to actuate valve 30 upon the pulling of trigger 34. Signal line 36 is preferably pneumatic, but may alternatively be electrical, or of any other conventional construction.

Figure 2:
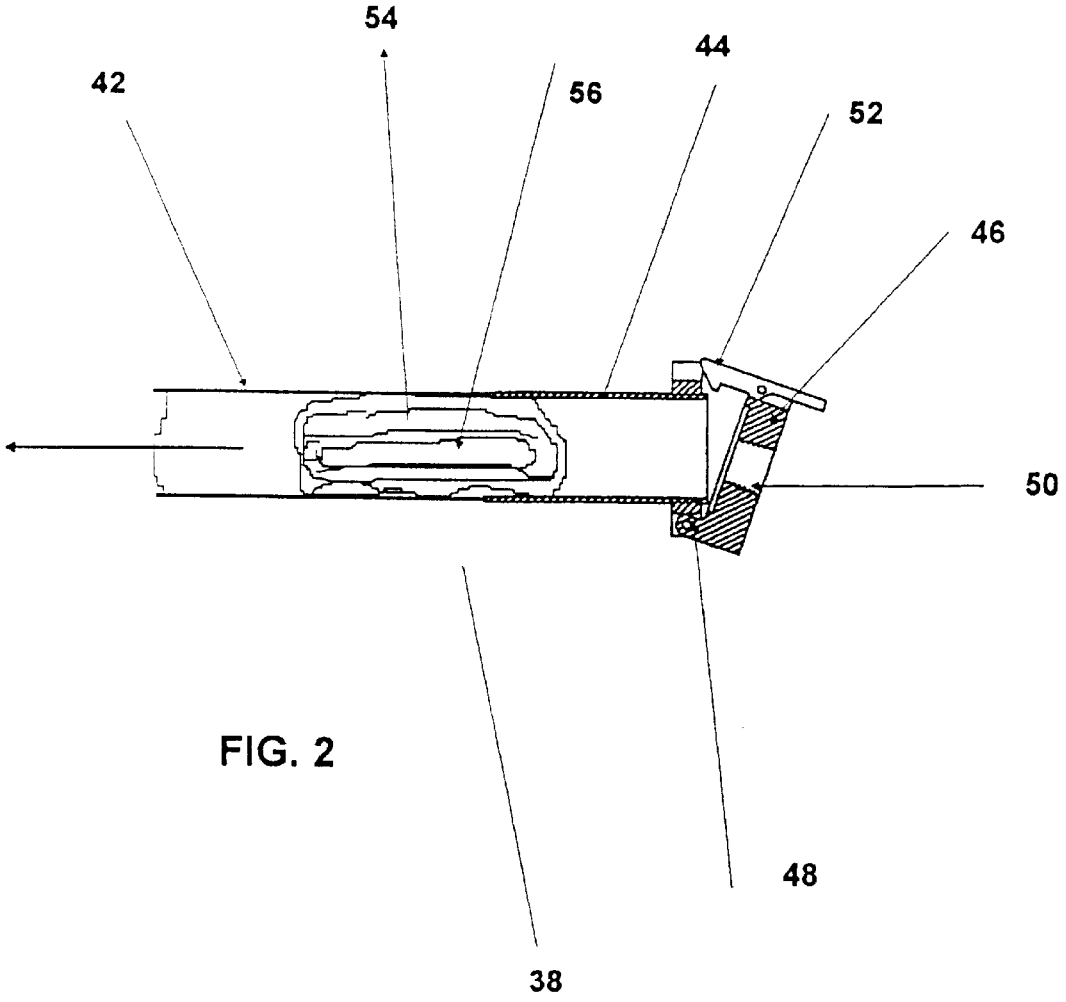
FIG. 2 is a cross-sectional fragmentary view of a portion of the system shown in FIG. 1.

Looking to FIG. 2, it will be seen that the stylized gun-like mechanism, which in the preferred embodiment is shaped to resemble a large hot dog, includes an elongated tube 42 having an inner wall 44 that defines a bore. At one end of the tube 42 is positioned a removable breech cover 46, which is hinged to the tube 42 by means of a hinge 48, and is releasably securable in a closed position to the tube by a releasable catch 52.

In operation, the system 10 is used to promote a product or a product brand at a public event in a way that is safe, fun, and very entertaining, in a way that can be described as follows. First, the product, which in the preferred embodiment is a hot dog 56, is wrapped in a wrapper that is designed not to come apart when flying through the air, that is relatively soft and without any hard or sharp edges, and that is flexible, compressible and relatively airtight. Preferably, the wrapper is a plastic bag 54, as shown in FIG. 2, and most preferably is a sealable plastic bag. The product 56 and its wrapper 54 are then placed within the breech end of the tube 42 by releasing the catch 52, opening the breech cover 46, placing the product and wrapper within the bore of the tube 42, and reclosing the breech cover 46. The product 56 and wrapper 54 are sized with respect to the bore of the tube 42 such that the compressible, relatively airtight package forms a seal with an inner wall 44 of the tube 42. The package that is formed by the wrapper 54 and the product 56 is then ejected out of the tube and toward an audience by pulling the trigger 34, which opens the remote controlled valve 30, which in turn releases the compressed gas that is stored in the accumulator tank, permitting the gas to flow through pressure line 32, through the connection 50 into the bore of the tube 42. As a result of the substantially airtight seal that exists between the package and the inner wall 44 of the tube 42, the package is efficiently ejected out of an outlet 40 of the tube, toward a part of the crowd at which the tube 42 has been pointed.

Besides a hot dog, the package could include such articles as napkins and condiments, or alternatively other foodstuffs such as pretzels or a hamburger.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of promoting a product or product brand at a public event that is safe, fun, and very entertaining, comprising steps of:

(a) wrapping a product in a wrapper that is designed not to come apart when flying through the air, that is relatively soft and without any hard or sharp edges, and that is flexible, compressible and relatively airtight;

(b) placing the product and its wrapper within a tube in a manner such that the compressible, relatively airtight package forms a seal with an inner wall of the tube; and (c) ejecting the product and its wrapper out of the tube and toward an audience by applying a pressurized gas within the tube, whereby the flexible, compressible and relatively airtight wrapper both helps seal the wrapper to the tube in order to make the ejection process efficient, and acts to keep the package together as it travels toward the audience.

2. A method according to claim 1, wherein step (a) is performed by wrapping the product within a plastic bag.

3. A method according to claim 1, wherein step (a) is performed by placing a hot dog, a napkin and at least one condiment within a sealable plastic bag.

4. A method according to claim 1, wherein step (a) is performed by placing an article of food selected from the group consisting of a hot dog, a hamburger and a pretzel within a sealable plastic bag.

5. A method according to claim 1, further comprising a step of mounting the tube on a movable vehicle that can be moved from place to place in a stadium or other public area.

* * * * *